United States Patent [19]

Woode

[11] 4,191,953

[45] Mar. 4, 1980

[54] INTRUSION SENSOR AND AERIAL THEREFOR

[75] Inventor: Alan D. Woode, South Queensferry, Scotland

[73] Assignee: Microwave and Electronic System Limited, Newbridge, Scotland

[21] Appl. No.: 803,918

[22] Filed: Jun. 6, 1977

Related U.S. Application Data

[63] Continuation of Ser. No. 543,613, Jan. 23, 1975, Pat. No. 4,079,361.

[30] Foreign Application Priority Data

Jan. 23, 1975 [GB] United Kingdom ..... 3209/75

[51] Int. Cl.[2] ..... G08B 13/18

[52] U.S. Cl. ..... 340/552; 343/5 PD; 343/771

[58] Field of Search ..... 340/258 R, 258 D, 276, 340/552; 343/5 PD, 100 PE, 771

[56] References Cited

U.S. PATENT DOCUMENTS

| | | | |
|---|---|---|---|
| 2,937,373 | 5/1960 | Carter | 343/771 |
| 3,328,800 | 6/1967 | Algeo | 343/771 |
| 3,456,261 | 7/1969 | Crumpen | 343/771 |
| 3,691,556 | 9/1972 | Bloice | 343/5 PD |
| 3,877,002 | 4/1975 | Cheal et al. | 340/258 R |

OTHER PUBLICATIONS

Terman, F. E., *Radio Engineers Handbook,* McGraw-Hill Book Co., Inc., New York, 1943, pp. 824–825 & 828–829.

*Primary Examiner*—Glen R. Swann, III

*Attorney, Agent, or Firm*—Sughrue, Rothwell, Mion, Zinn and Macpeak

[57] ABSTRACT

Perimeter protection in a security installation is achieved by detecting disturbances in a microwave beam sent from a transmitter to a receiver. The transmitter and receiver have associated beam antennas of extended vertical aperture of not less than 0.75 meters to mitigate the effects of ground reflection. The antennas are preferably slotted waveguide arrays and the advantages of using circular polarization are shown. Circularly-polarized slotted waveguide arrays are disclosed having a center feed to minimize frequency dependent beam-spreading.

11 Claims, 17 Drawing Figures

FIG.1.
PRIOR ART
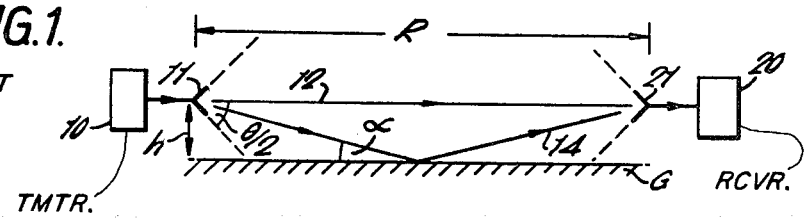
FIG.3.
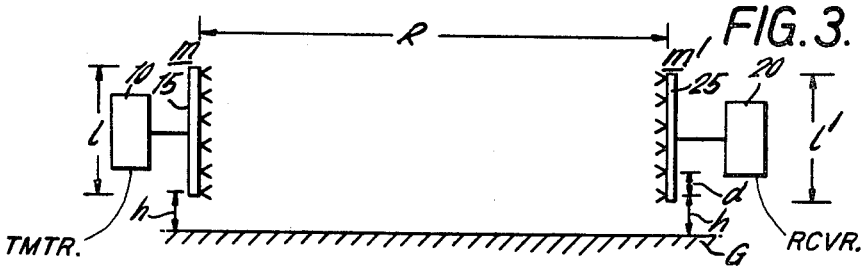
FIG.5a.
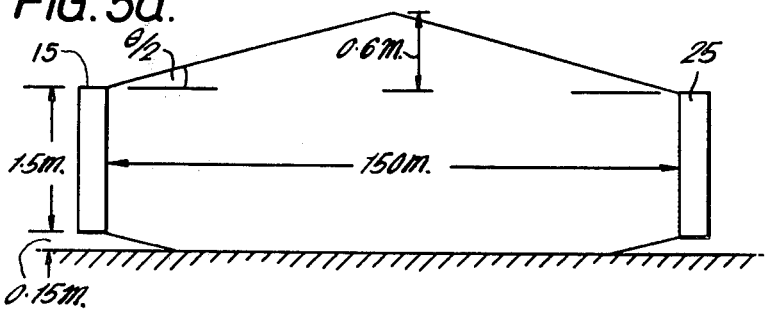
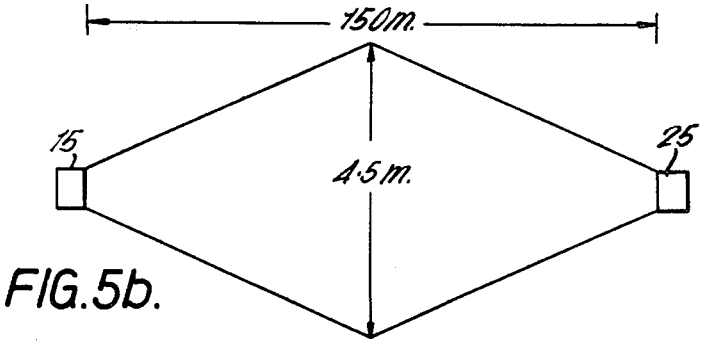
FIG.5b.

INTRUSION SENSOR AND AERIAL THEREFOR

This is a Continuation of application Ser. No. 543,613, filed Jan. 23, 1975 now U.S. Pat. No. 4,079,361.

BACKGROUND OF THE INVENTION

This invention relates to an intrusion sensor and is particularly concerned with the kind of intrusion sensor in which a beam of radiation is established and an alarm given if the beam is at least partially interrupted. Sensors of this kind are often known as "fences" since they define a boundary which it is considered illegitimate to cross.

Fence-type intrusion sensors are known and are conveniently operated at microwave frequencies at which aerials for achieving reasonably well-defined beams become of practical size. In the systems so far proposed a transmitter and receiver are each set up with their respective aerials (which are assumed to be the same) aligned along the boundary at which the fence is to be erected. The most commonly required fence-type intrusion sensor is one in which the aerials are not more than a few feet above ground so as to establish a fence which would be penetrated by a person walking across the surveyed boundary and which is not so far off the ground that it could be crawled under. The fence should be high enough not to be stepped over but not so high that the movement of an intruder through the fence produces too small perturbation of the received signal for reliable detection. The microwave fence systems proposed to date to meet this requirement can give rise to an undue number of false alarms and it is found that there may be considerable difficulty in reliably setting up these fences at certain ranges. Non-reliable operation results in undue numbers of false alarms or a failure to give an alarm where a real intrusion occurs.

Investigations now made into these problems have led to the conclusion that a major reason for the difficulties encountered so far lies in the fact that, at least in the vertical plane, the aerials have relatively wide beam-widths and at the ranges required in practice act as point sources which, as will be explained later, causes difficulties due to ground reflection along the surveyed boundary. It will be shown that such systems are liable to be highly sensitive to ground reflection which may lead to a null being realised at certain ranges. In addition the ground-reflected component is highly sensitive to variations in the effective ground level or height. This in turn shifts the null ranges. In real situations microwave fences are often set up over irregular terrain and/or terrain which is in the open and has growing vegetation. At microwave frequencies vegetation such as grass affects reflection thus leading to seasonal variations in the effective ground level. Shorter term variations can arise out of vegetation moving in the wind.

As a result of the above investigations it has been concluded that a more predictable and reliable performance of a microwave fence could be achieved by making the system less sensitive to ground reflection.

SUMMARY OF THE INVENTION

To this end it is now proposed to provide an intrusion sensor comprising a transmitter and associated aerial for directing radiation along a path to be monitored, a receiver and associated aerial for receiving the radiation transmitted along the path, the receiver including means responsive to a variation of the received radiation from an established level to give an intruder-indicative signal, wherein the transmitter and receiver aerials are each of a beam-forming kind and have a vertical aperture of not less than 0.75 m.

The use of beam-forming aerials having at least the vertical aperture above-mentioned leads to several advantages which will first be briefly outlined and subsequently described in greater detail.

It has been pointed out above that the fence should have at least sufficient height so as not to be readily avoidable by an intruder. The minimum height of the fence is determined by the vertical apertures of the aerials, the fence spreading vertically on moving away from the aerials due to beam divergence. For better security, it is preferred to use a vertical aperture greater than that quoted, say 1.5 m., though as mentioned the fence height should not be made so great that the movement of an intruder through the fence causes insufficient change in the received signal to provide reliable intruder detection.

A beam-forming aerial enables the effects of ground reflection to be at least substantially mitigated. To achieve best operation the striking angle $\alpha$ to the ground of the ground reflected ray path between the transmitter and receiver aerials should not be less than half the half-power beam-width ($\theta$) of each array, i.e. $\alpha \nless \theta/2$. This ensures that the reflected ray path lies outside the radiation patterns (−3 dB locus) of the aerials. $\alpha$ is a function of both the distance between the aerials and the aerial height; $\alpha$ decreases with range and increases with height. Thus at a great enough range $\alpha$ will eventually fall below $\theta/2$ but it will be shown how the present invention can be practiced such that the range at which this happens is in excess of that likely to be required in practice. Increasing $\alpha$ by increasing aerial height is not satisfactory since it is necessary in a practical fence for the fence to hug the ground. It will be shown how aerials comprised of a vertical array of radiators can be used at or adjacent ground level without difficulty from ground reflection. At present it is contemplated that the arrays should have a vertical half-power beam-width of not more 2°.

The desired beam-widths can be conveniently realised with vertical apertures of the size proposed at X- and K-band. For example, a vertical aperture of 1.5 m. at X-band will produce a half-power vertical beam-width of less than 1°. The same aperture at K-band will produce half this beam-width or the same beam-width can be achieved by an array 0.75 m. long.

It will be appreciated that at X- or K-band ($\lambda=0.03$ and 0.015 m. respectively), the aerial aperture is very large in terms of the number of wavelengths and in consequence very narrow beam-widths can be achieved with fence heights which are those desired in practice.

It is preferred that the beam-forming aerials employed in a sensor according to the present invention provide circular polarization. Such aerials render the sensor less sensitive to the orientation of an intruder, e.g. a man walking upright or crawling horizontally, than tends to be the case with linearly polarized aerials and the use of circular polarization can be of advantage in discriminating against reflections from vehicles, which is a factor that may arise in certain places where a fence is established. It is a further aspect of this invention to provide a slotted waveguide array suitable for this purpose.

In order to monitor the level of the received signal it is preferred to modulate the transmitter and to monitor the level of the detected modulation in the receiver. In addition it is desirable to make provision for compensating for long term variations in received signal level.

BRIEF DESCRIPTION OF THE DRAWINGS

In order that the invention and its practice may be better explained and distinguished from the prior point source aerial systems, there will first be described in greater detail a prior system followed by a description of a system embodying the present invention and modifications of it. Both systems are described with reference to the accompanying drawings in which:

FIG. 1 is a diagrammatic illustration of a system employing point source aerials;

FIG. 3 is a diagrammatic illustration of an intruder sensor system embodying the present invention;

FIGS. 5*a* and 5*b* show vertical and horizontal coverage patterns relating to an X-band system embodying extended aperture aerial arrays;

DESCRIPTION OF THE PREFERRED EMBODIMENT

Figure 2:
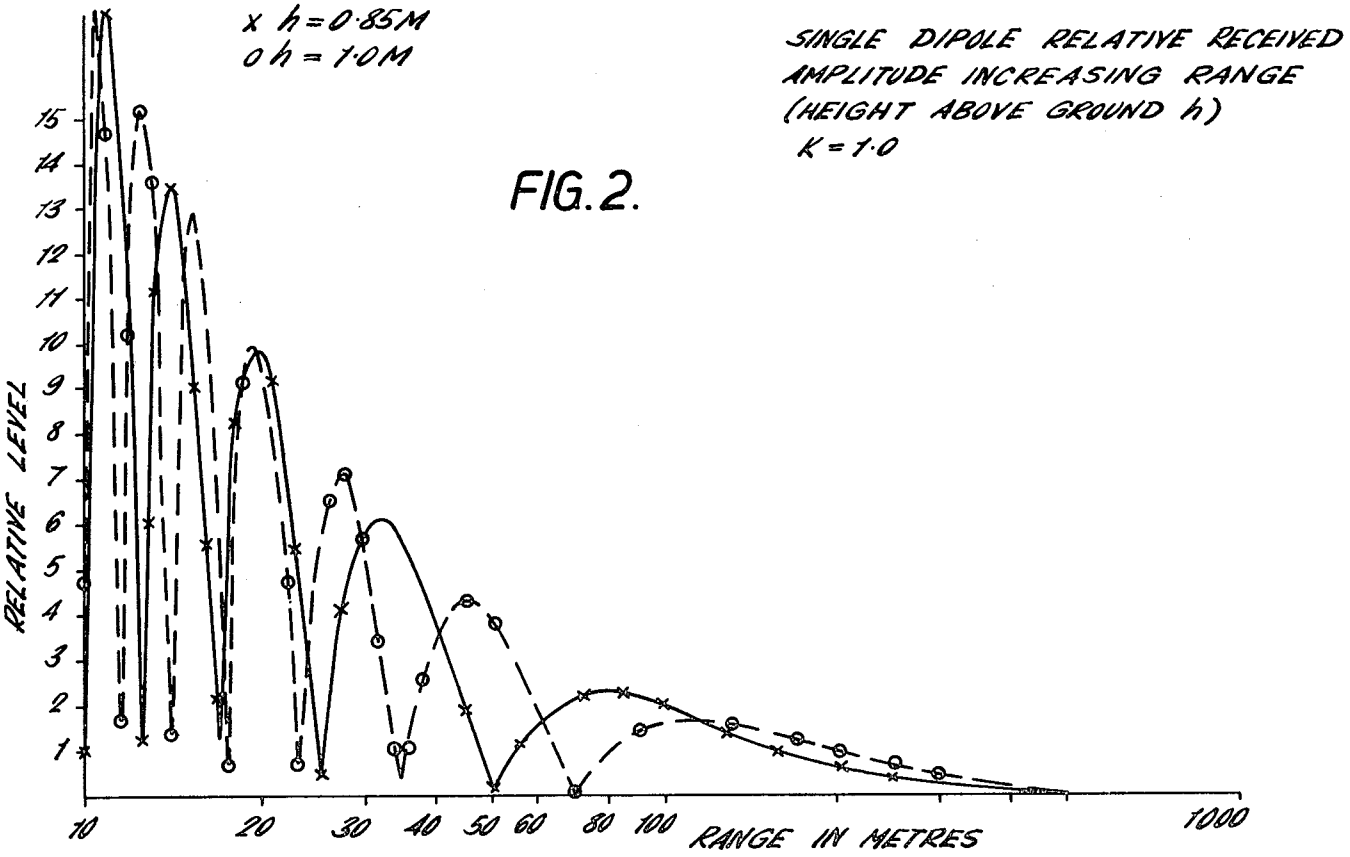
FIG. 2 is a graph showing calculated curves relating to the operation of the system of FIG. 1.

Referring to FIG. 1, there is shown a transmitter 10 with its associated aerial 11 of small vertical aperture and a receiver 20 with its associated aerial 21 which is assumed to be identical to aerial 11. The aerials are assumed to be horizontally polarised mounted over the flat ground G looking at one another, each being the same height h above ground and the aerial separation being a distance R. The receiver aerial 21 receives two components from the transmitter, a direct ray 12 and a reflected ray 14 which has a striking angle to the ground $\alpha$ which is assumed to be much less than $\theta/2$, where $\theta$ is the half-power vertical beam-width of the aerials. A small vertical aperture aerial would be expected to have a large value of $\theta$ so that the assumed relationship is likely to exist over practical ranges. FIGS. 1 shows how the reflected ray path 14 lies within the radiation patterns of the aerials 11 and 21, the −3 dB locus of which is indicated by the dashed lines. On these assumptions the transmitter and receiver aerials can be regarded as point sources.

It can be shown that for horizontal polarization the received field strength $F_R$ at the receiver is given by $$F_R = \frac{F_T}{R}(1 + K\angle\phi) \tag{1}$$

where $F_T$ is the field strength at the transmitter aerial,

K is the ground reflection coefficient, and $\phi$ is given by the expression $$\phi = \frac{2\pi}{\lambda}[(4h^2 + R^2)^{\frac{1}{2}} - R] + \pi \tag{2}$$

where $\lambda$ is the operating wavelength.

$F_R$ thus consists of two components, $F_T/R$ being the direct ray component and $F_T K\angle\phi/R$ being a reflected ray component which is vectorially combined with the direct ray component.

First of all it is instructive to consider the variation of the resultant received field $F_R$ with R. This can best be appreciated from a graphical plot shown in FIG. 2 where the curves show computed values of relative received field (ordinate) as a function of range R (abscissa), each aerial being a single dipole. The full-line curve is drawn for computed values (indicated by crosses) at an assumed dipole height h of 0.85 m. and the reflection coefficient K being taken as unity. It is clear that the received field strength varies considerably for different transmitter and receiver aerial ranges R with distinct nulls at certain range value.

The system is highly sensitive to height variations. The dashed line curve, computed values of which are shown by circles, is a replot of the system performance with the height increased by 0.15 m. to 1.0 m. This is a small increase but has a marked effect upon the null range values. The height variation is one easily achieved by growing vegetation which in changing the effective ground level could cause a marked change in system performance. Although an automatic gain control system could partly compensate for slow effective ground level changes, the system might be left at a null range with less than a usable signal level. Also it will be appreciated that the effects of wind movements could well be to disturb vegetation by up to several centimeters thus rapidly shifting the signal levels in a manner which could not be distinguished from a change due to an intruder and thereby causing false alarm indications to be given.

The effects of ground reflection can be reduced by having the system operate such that the striking angle $\alpha$ of the reflected ray is substantially greater than the half-power beam-width $\theta/2$. Looked at in another way this means the path of the reflected ray 14 of FIG. 1 would then lie substantially outside the radiation pattern of the fence and thus the reflected component would be small. The striking angle $\alpha$ increases with decreasing range R and if, as in FIG. 1, $\theta$ is large the obtaining of the condition where $\alpha > \theta/2$ implies operation at only small values of R to avoid troublesome ground reflection.

The striking angle $\alpha$ is also dependent on aerial height h and can be increased by increasing the aerial height. However, increasing $\alpha$ in this manner does not provide a practical solution because the microwave fence would then leave large areas of the ground surface, particularly adjacent the aerials, outside the aerial beam patterns. Thus the system of FIG. 1 using small vertical aperture aerials cannot provide reliable intrusion detection at the ranges required in practice because at such ranges where $\alpha < \theta/2$ the ground reflection component gives rise to the difficulties explained above. From FIG. 2 it can be seen that for a simple dipole the first null range is as little as 12 m. which is far less than the sort of range required in practice.

The present invention stems from an appreciation of the importance of substantially reducing the ground reflected component. Such a reduction can be achieved at practically required ranges by reducing the half-power beam-width of the aerials so that $\theta/2$ is less than the striking angle $\alpha$, though this is not to be taken as a definitive statement for all situations. In order to achieve this the aerials have large vertical apertures thereby reducing the beam-width $\theta$ and the apertures are made not less than 0.75 m. long in order to provide a reasonable minimum fence height.

FIG. 3 diagrammatically illustrates a system embodying the present invention, illustrated in a manner corresponding to FIG. 1. It will be assumed that the transmitter 10 and receiver 20 remain the same but instead of small aperture aerials 11 and 21, large vertical aperture aerials 15 and 25 are employed.

Each aerial is an array of vertically stacked elements such as may be realised at X-band frequencies by an array of slot radiators which will be assumed to be horizontally polarised. The number of elements in arrays 15 and 25 will be designated m and m′ respectively, though in practice m and m′ will probably be equal. The vertical extent of the arrays is l and l′ respectively and the height above ground G of the lowest element in each array is the same h. The element spacing is uniform and denoted d and the elements are assumed to be fed in-phase.

The use of a multi-element array is helpful in providing gain for the system and more particularly for reducing the vertical beam-width. With an array of the kind contemplated the half-power beam-width may be readily brought down to 1° or less which would be much less than the striking angle $\alpha$ of any reflected component over practical ranges, i.e. $\theta/2 << \alpha$.

For a beam-forming aperture of extent l, where l is large relative to the operating wavelength $\lambda$, the half-power beam-width is given approximately by the expression $$\theta \simeq \lambda/l \text{(radians)} \tag{3}$$

Following from the discussion given above, in order to mitigate ground reflection effects the path of a ground reflected ray between the transmitter and receiver should lie outside the −3 dB locus of the aerial radiation patterns. As mentioned the striking angle $\alpha$ decreases with range and if the limiting range Rmax is taken as that at which $\alpha = \theta/2$, Rmax is given by $$\text{Rmax} \simeq 4(l^2 + lh)/\lambda \tag{4}$$

At ranges below Rmax, the point source view of FIG. 1 cannot be applied and a general formula for the received signal will now be given.

For the case where each aerial 15 and 25 is an array of dipoles (or other elements allowing for the relative gain factors) at half-wave spacing, i.e. $d = \lambda/2$, the resultant received field strength $F_R'$ as represented by the input signal to the receiver is given by $$F_r' = \frac{F_T}{R} \sum_{n=1}^{n=m} \cdot \sum_{n'=1}^{n'=m'} (1 \cdot \angle\psi + K \cdot \angle\phi') \tag{5}$$

where $F_T$, R, K, m and m′ are as given above $$\psi = \frac{2\pi}{\lambda} [(R^2 + (n' - n)^2 d^2)^{\frac{1}{2}} - R] \tag{6}$$

and $$\phi' = \frac{2\pi}{\lambda} [((2h + (n + n' - 2)\, d)^2 + R^2)^{\frac{1}{2}} - R] \div \pi \tag{7}$$

d is the half-wave dipole spacing in absolute measure, and n and n′ are unit array elements in the transmitter and receiver arrays respectively under consideration.

It will be seen that $F_R'$ is again due to two vectorially added components, a direct component represented by $F_T.\angle\psi/R$ and a reflected component represented by $F_T K \angle\phi'/R$. It is important to note that each component is itself a vector summation of a series of sub-components representing the signal received by each element in the receiver array from each of the elements in the transmitter array.

From this general formula (5) can be derived the conclusion that it is possible to ensure that the resultant reflected component is substantially less than the resultant direct component, thereby enabling the system performance to be far less dependent on ground reflection and thus on the effects of changes in the effective ground level. This is easier considered in terms of the resulting narrow beam-width in the vertical plane allowing little reflection to occur even with small values of h. These conclusions may be better appreciated from the graph of FIG. 4 the curves of which are to be contrasted with those of FIG. 2.

Figure 4:
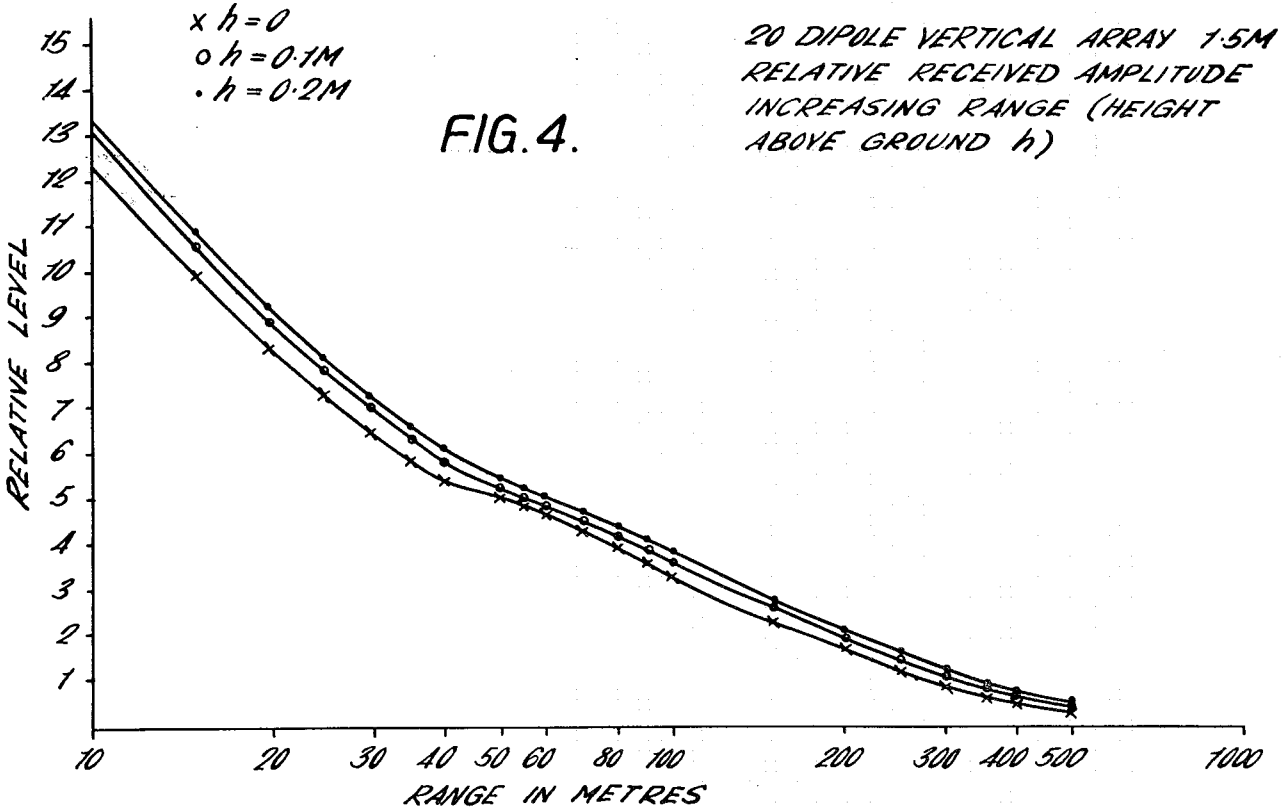
FIG. 4 is a graph showing calculated curves relating to the operation of the system of FIG. 3.

FIG. 4 shows curves of relative received field strength against range R for a system operating at X-band and having identical transmitter and receiver aerial arrays, each comprising 20 dipoles ($m = m' = 20$) stacked over a height $l = l' = 1.5$ m. This gives an apparent spacing d of 7.9 cms., which is much in excess of a half-wavelength. In fact a 1.5 m. long array would contain 100 dipoles at X-band with a half-wavelength spacing. To simplify computation only every fifth dipole was considered. Three curves are plotted of computed values of relative field strength for array heights h (FIG. 3) of 0, 0.1 m. and 0.2 m. respectively represented by crosses, circles and dots.

It is clearly apparent from FIG. 4 that:

(1) The curves fall smoothly with range and are free of nulls (2) The curves are comparatively height insensitive even down to an array mounted directly on the ground.

Thus by employing large vertical apertures, the performance of the system at different locations is far more predictable and for less liable to variation once installed due to growing vegetation altering the effective value of h or to movement of such vegetation effecting h. Thus the false alarm probability is greatly reduced and there are no null ranges at which the system will not operate satisfactorily.

FIGS. 5*a* and *b* show diagrammatically in different vertical and horizontal scales the extent of the microwave fence produced by use of the aerial arrays for which the performance curves of FIG. 4 were obtained. FIG. 5*b* shows that at a range of 150 m. the fence is 4.5 m. wide at the mid-point taking the half-power horizontal beam-width as the criterion by which the fence "edge" is denoted. In the vertical plane (FIG. 5*a*) the divergence is much less, about 0.6 m. vertically upward from the height of the top of the aerials above ground. This corresponds at a range of 150 m. to a half-power beam-width $\theta$ of about 0.9°. The vertical angular beam divergence is groosly exaggerated in the vertical plane as seen in FIG. 5*a*. A range of 150 m. is easily accomplished for a transmitter power of a few milliwatts and reliable operation at greater ranges is possible as is shown by calculations made below. It is to be noted that the array structure described is mountable very close to or even on the ground to provide a ground-hugging fence which cannot be crawled under and yet does not have an erratic performance due to ground reflection.

To further illustrate the benefits obtained by a large vertical aperture aerial consider the example already given for an X-band intrusion sensor in which $\lambda=0.03$ m. and $l=1.5$ m. Equation (3) gives $\theta$ to be approximately 1°. From equation (4), assuming a value for h of 0.2 m., Rmax is approximately 430 m. At K-band ($\lambda=0.015$ m.) for a 1.5 m. long array Rmax would be 860 m. These figures for operation without ground reflection problems are very substantially in excess of those obtainable by the system of FIG. 1. At long ranges diffraction effects are more likely to be the limiting factor on the effective system sensitivity.

Figure 6:
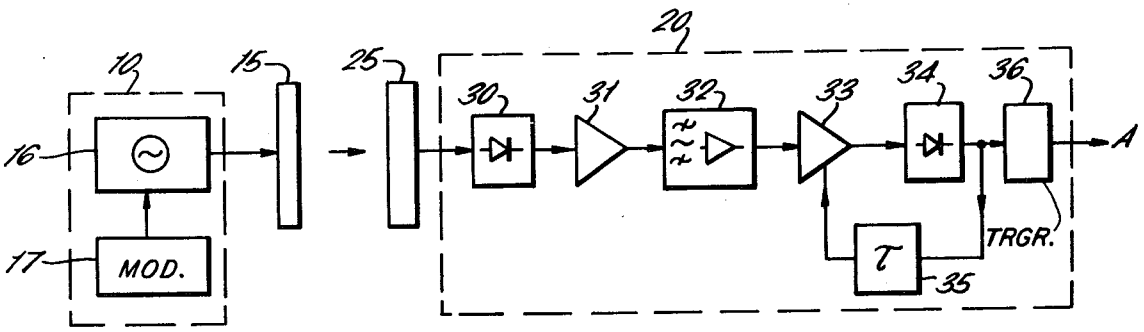
FIG. 6 is a block diagram of the system showing the main transmitter and receiver units.

In order that best advantage can be taken of the large vertical aperture arrays, there will now be described with reference to FIG. 6 a block diagram of an intrusion sensor embodying same. In FIG. 6 the transmitter 10 comprises a microwave source 16 such as a Gunn diode and an amplitude modulator 17 which may be provided by a multivibrator giving square wave modulation at a selected frequency in the audio range. The modulated Gunn diode output in X-band say, is applied to the aerial 15 which may be an extended array of slot radiators giving the kind of response already discussed and which for weather protection is preferably entirely enclosed with a low-loss radome through which the X-band radiation is emitted. The transmitter 10 can also be enclosed within the same housing.

The receiver 20 has a similar aerial 25 feeding a microwave detector 30 to recover the audio modulation with a following preamplifier 31 for the modulation which is followed by a filter/amplifier 32 having a passband at the modulation frequency. The filtered signal passes to a gain controlled stage 33 which is in an automatic gain control (a.g.c.) loop acting to establish a substantially long term constant modulation signal output for further processing. The filtered modulation signal is itself rectified by detector 34 to provide a d.c. signal the level of which follows the modulation signal level. Part of the d.c. signal is fed back as an a.g.c. signal to stage 33 via a time delay circuit 35, e.g. an R.C. delay circuit. The delay circuit has a delay $\tau$ greater than 1 minute.

Thus the operation of the a.g.c. loop is to maintain the d.c. output of detector 34 substantially constant for long term variations. However relatively rapid input signal variations such as those due to the movement of an intruder through the microwave fence between aerials 15 and 25 will not be compensated by the slow acting a.g.c. loop and will appear as corresponding changes in the d.c. signal from detector 34. The d.c. signal is applied to a threshold circuit 36 which may be a Schmitt trigger for example, so that a sufficient change of the d.c. signal level activates the Schmitt trigger to produce an alarm signal A. The threshold circuit 36 can be arranged to be activated on positive and/or negative going changes.

Figure 6A:
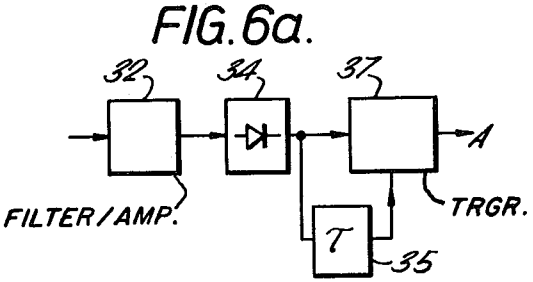
FIG. 6*a* shows a modification of the receiver.

FIG. 6*a* shows a modification of the receiver of FIG. 6 in which the time delayed a.g.c. circuit is replaced by a time-delayed feed forward circuit. The receiver circuit is the same up to filter/amplifier 32 which feeds the filter modulation signal directly to detector 34 so that the d.c. output signal of the latter reflects long term as well as short term changes in signal level. The detector output goes to a threshold circuit 37 via two paths—one direct and the other through a time-delay circuit 35, the signal from the latter acting as a reference signal. The time-delay circuit 35 has the same time delay $\tau$ as already mentioned. Circuit 37 responds to short term variations at its direct input which exceed a given percentage of the reference input. The threshold response of circuit 37 is thus automatically adjusted for long term variations in the quiescent signal from detector 34 but not for short term changes which can thus trigger the threshold circuit to produce an alarm signal A.

It will be appreciated that the setting up and adjustment of operating signal levels in the receiver is much less likely to run into difficulty then with the system of FIG. 1, though it should be noted that the feed-forward system just described will require an initial, though not critical adjustment, whereas the a.g.c.-controlled system should be operable without any initial setting up if the a.g.c. range is made great enough. The performance of the now proposed system at a given range is far more predictable and the receiver sensitivity is adjusted accordingly. Preferably the gain of at least one of the receiver amplifiers is made adjustable to allow for range and also the threshold level in circuit 36 or 37 is made adjustable to allow for target size.

The transmitter above described uses a Gunn diode oscillator to generate the required microwave power. The Gunn diode is mounted in a resonant cavity whose stability determines the frequency stability of the microwave radiation. A system used out-of-doors is, of course, subject to wide temperature variations and it is desirable that the resonant cavity should have a resonable temperature stability. The importance of this lies in the fact that in a long linear array, the beam direction will vary slightly with frequency. An array designed to give the required broadside beam at the nominal working frequency will therefore tend to shift the beam direction slightly in the vertical plane.

The beam shifting problem can be further alleviated by centre-feeding of the linear array. Considering the two halves of the array as separate beam forming aerials, they act to shift their beams in opposite directions for a given frequency change and produce a cancelling effect as regards the beam from the whole array.

Figure 7A:
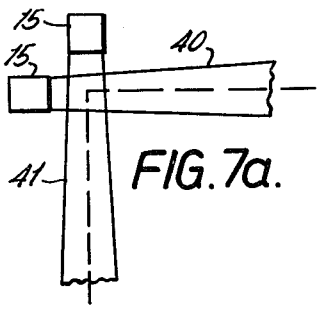
FIGS. 7*a* to 7*c* diagrammatically illustrate various ways a system according to the invention may be used to provide a non-straight protective fence.

Some aspects of practical security systems will now be briefly discussed. An area to which a fence-type intrusion sensor is to be applied may well have a corner along the surveyed perimeter. A corner can be dealt with by arranging separate protection along adjacent perimeter sections leading from the corner. This is shown in FIG. 7*a* where the perimeter sections are indicated by dashed lines and two separate fences 40 and 41 are set up and overlap at the corner.

Figure 7B:
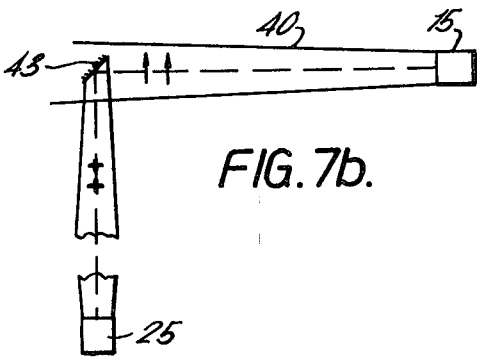

A saving of equipment may be made by having a single fence 40 which turns the corner by way of a passive reflector 43 as shown in FIG. 7*b*. The passive reflector is preferably of a polarisation—twisting kind which changes the polarisation of incident radiation by 90°. With a single reflector this would, of course, require the polarisation of the receiver and transmitter aerial arrays 15 and 25 to be orthogonal, e.g. a stack of vertically-polarised elements in one array and a stack of horizontally-polarised elements in the other. The advantage of the 90° twist polarisation in polarisation is that unwanted reflections from, for example, a passing vehicle in the proximity of the fence would not be subject to the 90° polarisation change and would thus not be responded to by the receiver aerial.

One way of avoiding the need for different aerial arrays at the transmitter and receiver is to use a 45° slant polarisation of the same hand in both arrays. Such arrays would of course be cross-polarised if set up to directly look at one another.

Figure 7C:
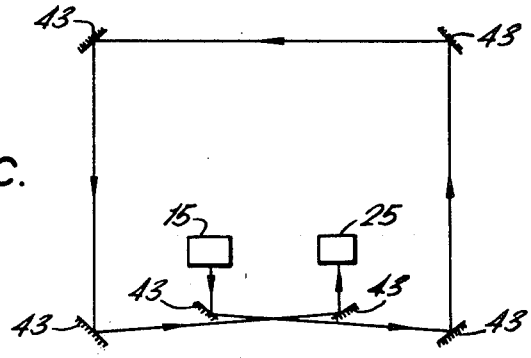

Also identical aerial arrays of the same vertical or horizontal polarisation can be used where the number of 90° polarisation changes along the fence is 2n. An example of this is shown in FIG. 7*c* in which the boundary of a rectangular area is protected by a single fence without gaps by using six 90° polarisation-twisting reflectors 43.

Polarisation-twisting reflectors are described, for example, at page 447 of "Microwave Antenna Theory and Design" by Silver, one of the MIT series published by McGraw Hill. This reference describes this technique in relation to a parabolic reflector but it is readily adapted to the planar reflectors described here.

Figure 7D:
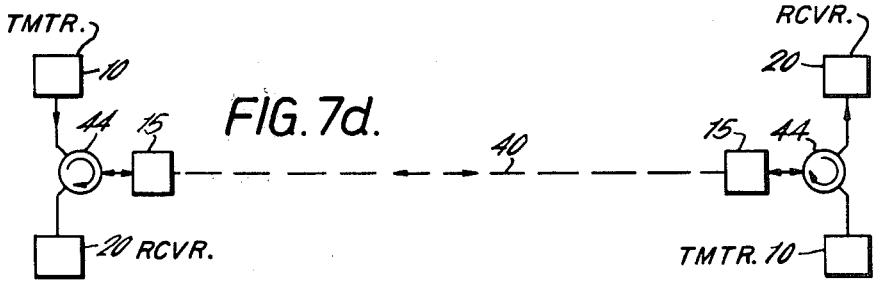
FIG. 7*d* shows a further modified bi-directional fence.

Another possible variation is to have a two-way fence, as shown in FIG. 7*d*. Here each end of the link comprises a transmitter 10 and receiver 20 each connected to common large vertical aperture aerial array 15 through an isolating coupler 44 such as a circulator. Transmission is reciprocal. This system may find use in especially high security service.

In intrusion sensors where two or more fences are established in close proximity and in particular a system such as shown in FIG. 7*d* there is always a risk of mutual interference due to radiation from the transmitter of one fence being picked up by the receiver of the other. To minimise such problems, the use of modulated sensors is preferred because different modulation frequencies may be applied in proximate sensors and the respective filter in the receiver used to ensure that the required modulation frequency is extracted for further processing. Although the use of large vertical apertures has been described mainly with reference to horizontal polarization the benefits obtained by such arrays, as illustrated in FIG. 4, are also obtained with vertical and circular or elliptical polarization. Circular polarization is of particular interest as its use can bring other advantages.

Where linear polarization is used a generally elongate target which is oriented normal to the plane of polarization will produce less change in the received signal than would the same target if it were aligned with the plane of polarization. The use of circular polarization obviates this difficulty as it has no preferred direction. Thus a system using circular polarization is more likely to approach equal sensitivity to a person walking vertically or crawling horizontally through the beam.

Circular polarization is also helpful in avoiding false indications from passing vehicles a problem which has already been discussed with reference to polarization-twisting reflectors. A metallic surface parallel to the beam of a microwave fence will reverse the phase of the component of circular polarization which is parallel to that surface, whatever the angle of incidence. The component normal to the surface is not reversed in phase. This is in accordance with the normal rules of radio wave reflection and results in the sense of rotation of the reflected wave being opposite to that of the incident wave and thus opposite to that of the main beam received at the receiver aerial. Therefore, it is possible to discriminate between the direct and reflected signals by means of a receiver aerial which responds only to the wanted sense of rotation.

This discrimination against unwanted reflections only holds for very good conductive surfaces, i.e. metal, substantially parallel to the beam. It only partially holds for ground reflections, the ground being a surface parallel to the beam but a relatively poor conductor. For reversal of the rotational sense upon ground reflection, the striking angle $\alpha$ of the beam (FIG. 1) has to be high. At low angles, such as those which have been discussed in regard to the teachings of the present invention, both the magnitude and phase of the reflection coefficient for the vertical component vary rapidly as is well known, the magnitude of the coefficient reaching a minimum at the Brewster angle and the phase of the reflected wave rapidly changing from a substantially in-phase to a substantially anti-phase condition at angles below the Brewster angle (typically atX-band about 2° over normal ground).

At these low angles the sense of rotation remains unaffected by reflection and is therefore responded to by the receiver aerial though the reflected wave may be elliptically rather than circularly polarised as a result. Thus to merely substitute circular for horizontal polarisation in the system of FIG. 1, with other aerial parameters remaining unchanged, would not provide a solution to the problems of ground reflection.

Figure 8:
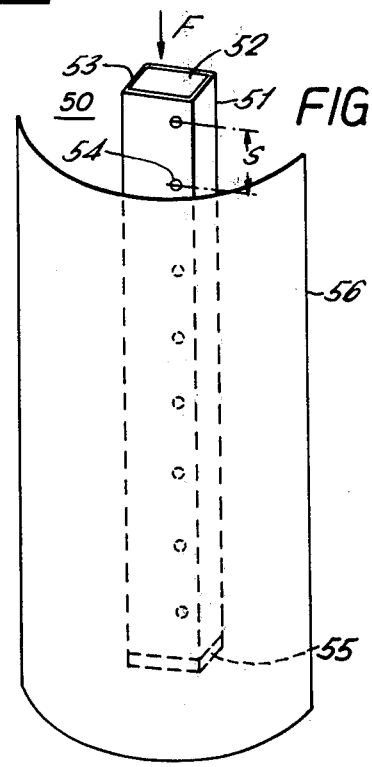
FIG. 8 is a simplified perspective view of an aerial array usable in the system of FIG. 3 and providing circular polarization.

Another aspect of the invention lies in the provision of a large aperture linear array having circular polarisation. One such microwave array is illustrated in FIG. 8.

The array 50 is a slotted waveguide type and comprises a solid dielectric waveguide 51 having a dielectric core 52 plated with metal 53 the thickness of which is exaggerated in the figure. At uniform intervals s along one broad wall off-set radiating apertures 54 are provided. These apertures can be circular holes or X-shaped (the term slotted-waveguide is used broadly to encompass any shape of apertures). A full discussion of a linear array using such apertures to obtain circular polarization is to be found in an article entitled "Circularly Polarized Slot Radiators" by A. J. Simmons in a Naval Research Laboratory report (Problem No. R09-02) published in 1956.

The linear arrays described in that report require the apertures to have a spacing of one wavelength in the waveguide ($\lambda g$). As $\lambda g$ in an ordinary waveguide is greater than the free space wavelength $\lambda$, the spacing of the apertures as radiators into free space is well in excess of $\lambda$. The use of such a large spacing produces side lobes in the desired beam or even end fire lobes which in effect increase the beam width of the array beyond that which can be tolerated for the purposes of the practice of the present invention. In order to obtain a narrow beam of the kind required for the practice of the present invention the aperture spacing s, which in the waveguide is equal to $\lambda g$, should also be within the range given by $$\lambda/2 \leqq s \leqq \lambda \quad (8)$$

To obtain such values of aperture spacing the guide wavelength $\lambda g$ has to be reduced and loading of the waveguide to reduce λg is discussed in the above noted paper. In the slotted waveguide radiator shown in FIG. 8, the loading is obtained from the dielectric core 52 which produces a loaded guide-wavelength λlg given by $$\lambda lg=\lambda/\sqrt{\epsilon-(\lambda/\lambda c)^2} \quad (a)$$

where λc is the unloaded guide cut-off wavelength and ε is the dielectric constant of core 52.

The radiating apertures 54 are off-set from the longitudinal axis of the broadwall toward one side in order to obtain circularly polarized radiation as is explained in the report abovementioned, the degree of offset being chosen to give the best circularity. A better understanding of the mechanism by which circular polarization is obtained will result from the description later of slotted waveguides of FIGS. 10 and 11. If the waveguide is fed from one end as indicated by arrow F in FIG. 8 the other end must be terminated in a matched load 55 in order to prevent reflections. The sense of the radiated circular polarisation depends on the direction of wave propagation in the guide 51 and a reflected wave from the lower end of the waveguide would tend to make the induced circular polarization revert to linear polarization.

As well as terminating the guide in a matched load it is desirable to gradate the coupling of the apertures 54 to the waveguide 51 in order to obtain the required power distribution for achieving the desired narrow beamwidth of the array. Obviously more power is available at the feed end of the waveguide than at the load end and the coupling can be adjusted by controlling the size of the radiating apertures 54.

Thus the array 50 can be designed to meet the requirements of:

(1) an array not less than 0.75 m. high;
(2) a narrow beamwidth in the vertical plane without excessive side-lobes; and
(3) circular polarization.

Finally to narrow the horizontal beamwidth, and thereby aid in reducing reflections from passing traffic, the slottedwaveguide 51 radiates into a semi-parabolic reflector 56.

Figure 9:
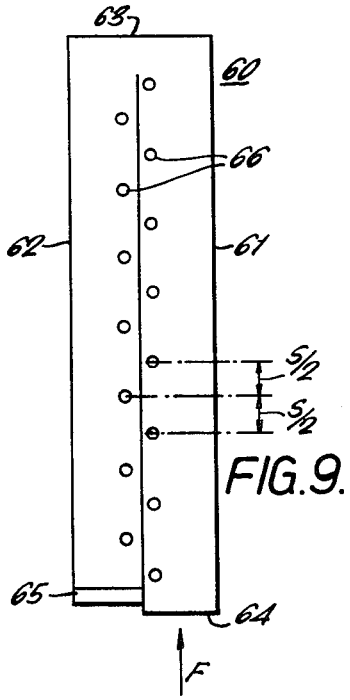
FIG. 9 is a simplified front view of another aerial array providing circular polarization and usable in the system of FIG. 3.

FIG. 9 illustrates an alternative array 60 which is again based on the principles given in the report referred to above. Here a different approach is made to the problem of obtaining a spacing which meets condition (8) given above. The array 60 has two parallel waveguide sections 61 and 62 which are coupled in series via a u-section 63. One of the two sections 61, 62 is fed at the lower end 64 while the lower end of the other is terminated in a matched load 65 for the reasons given above. The waveguide sections 61, 62 may be loaded or unloaded and have apertures 66 spaced there along at a distance s between adjacent apertures in one waveguide, the apertures being formed to produce circular polarization as previously discussed. The radiating apertures 66 in the two parallel sections are staggered vertically so that an aperture in one waveguide section lies midway in the vertical direction between two apertures in the other waveguide section and produces circular polarization of the same sense. Thus while in any waveguide section the aperture spacing $s=\lambda g$, the effective array element spacing is s/2 and it is then possible by appropriate design to meet condition (8) by making $\lambda/2 \leqq \lambda g/2 \leqq \lambda$.

In order to maintain the λg spacing of the apertures in the waveguide sections the distance around the u-bend between the respective uppermost apertures in sections 61 and 62 has to be maintained at λg or a multiple thereof. As with array 50, the coupling of the radiating apertures to the waveguide sections can be gradated in order to obtain the power distribution which gives the best beam from the array. The array 60 may also use a semi-parabolic reflector 56 to reduce horizontal beamwidth.

The arrays 50 and 60, with or without the reflectors, can be used as the aerials 15 and 25 in the system of FIG. 3.

Figure 10:
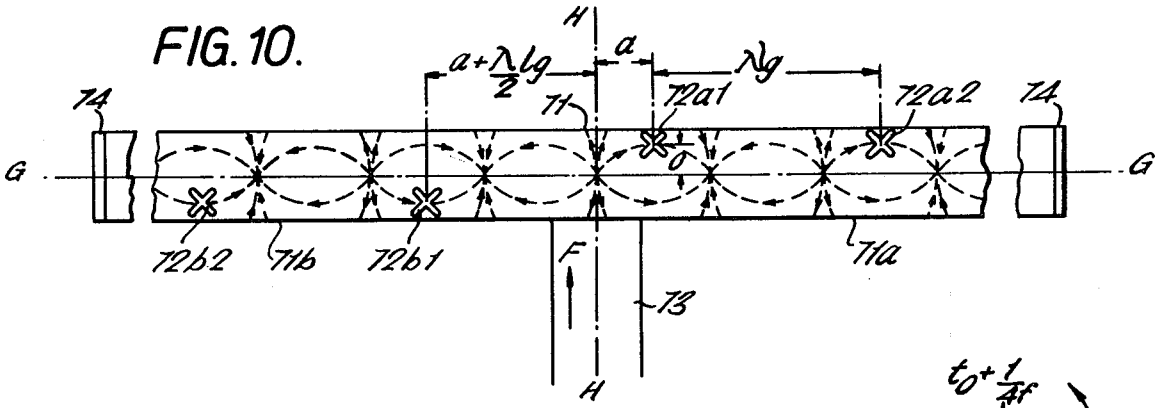
FIG. 10 shows a first modification of the slotted waveguide array of FIG. 8 to alleviate beam spreading.
Figure 12:
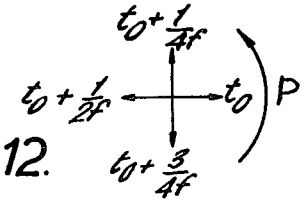
FIG. 12 is an explanatory diagram relating to FIGS. 10 and 11.
Figure 11:
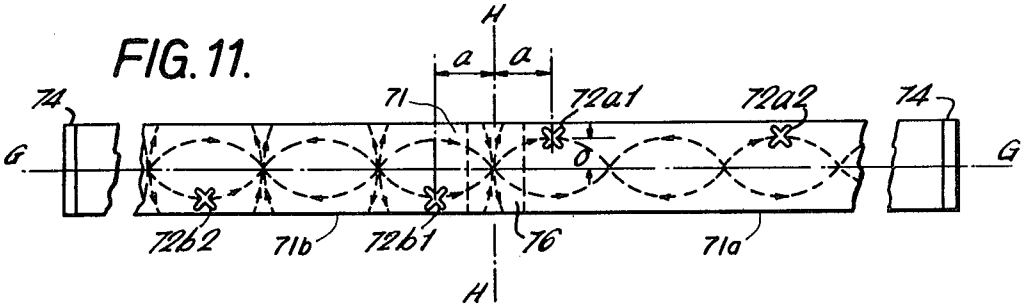
FIG. 11 shows a second modification of the slotted waveguide array of FIG. 8 to alleviate beam spreading.

Referring again to the system of FIG. 6, mention has already been made of the problem of transmitter frequency changes causing beam shifting and the alleviation of the problem by centre-feeding a linear array. The use of the end-fed array 50 of FIG. 8 may thus give rise to beam-shifting problems. It has been realised that merely centre-feeding the array of FIG. 8 is not a satisfactory solution because the two halves of the slotted waveguide would have opposite directions of wave propagation therein and thus would have opposite senses of circular polarisation giving a resultant array beam that was linearly polarised. It is necessary therefore to add to the centre-feeding some way by which the same rotational sense of polarisation is obtained from the two waveguide halves. FIGS. 10 to 12 illustrate how this may be achieved. These arrays are believed to be novel in themselves and are the subject of another aspect of this invention as well as constituting a preferred linear array for use in an intrusion sensor according to the invention.

FIGS. 10 and 11 show similar slotted-waveguide arrays adapted for shunt and series feeding respectively.

FIG. 10 shows the central portion of a length of dielectric loaded slotted rectangular waveguide 71 having radiating apertures 72 in one broad wall. Each aperture is offset by a distance o from the longitudinal centre line G—G of the broad wall though, unlike the FIG. 8 array, the apertures are not all offset on the same side of the centre line as will be discussed later.

The array is shunt-fed through a feed-waveguide 73 coupling to an aperture in a narrow wall of the waveguide 71. Various shunt feeding techniques are well known to those in the art and require no further description here. The feed-waveguide axis is denoted H—H. Power fed in the direction of arrow F enters the slotted-waveguide 71 where it divides equally to right and left of the axis H—H and propagates along the respective waveguide halves 71*a* and 71*b* each of which is terminated in a respective matched load 74 to prevent reflections. It will be assumed that each waveguide half-section 71*a* and 71*b* contains the same number of apertures 72. The apertures 72 are shown here specifically as being X-shaped slots and the degree of coupling to the waveguide is controllable by adjustment of the slot dimensions. In each half of the waveguide 71 the apertures 72 are spaced by the loaded guide wavelength λlg given by equation (9) above.

The mechanism by which circular polarization is obtained is as follows:

The chain lines show the current distribution along the broad wall of the waveguide 71. The distribution shown is an instantaneous one at a time $t_o$, the current patterns in the two waveguide halves 71*a* and 71*b* moving along the guide to the right and left respectively as seen in the drawing. The current pattern in each half recurs (both in magnitude and sign) at the guide wavelength λlg. With shunt feed the current patterns in the two waveguide sections 71*a* and 71*b* are mirror images about the feed-axis H—H. Consider one of the apertures in section 71*a*, say 72*a*2. At the instant $t_o$ the current direction adjacent this aperture, and which is cut by the aperture to establish a radiating e.m.f., is parallel to the direction of centre line G—G and given by the current component arrow labelled $t_o$ in FIG. 12. A quarter cycle later at time $t_o+\frac{1}{4}f$ (where f is the feed frequency) the current pattern has moved a quarter cycle to the right and the direction of the current component is now perpendicular to centre line G-G and thus has turned through 90°, as does the induced radiating e.m.f.. The remaining current components intersecting aperture 72*a*2 at ($t_o+\frac{1}{2}f$), ($t_o+\frac{3}{4}f$) are readily seen from an inspection of the current distribution pattern and it will be seen that the current component rotates in the direction of the arrow P indicating the sense of rotation of the circular polarization. To obtain true circular polarization the longitudinal current components ($t_o$ and $t_o+\frac{1}{2}f$) should be equal in magnitude to the transverse current components ($t_o+\frac{1}{4}f$ and $t_o+\frac{3}{4}f$) and the off-set o of the slot 7 is selected to obtain as near equality as possible between these orthogonal components.

Looking now at the other half of 71*b* of the array, consider aperture 72b2 which is positioned so that the current component intersecting it has the same instaneous direction as that of aperture 72a2. As the current pattern in section 71*b* is moving to the left, it will be seen from inspection that the current component rotates in synchronism with that illustrated in FIG. 12.

The radiating apertures in section 71*b* are spaced at λlg so that the diagram of FIG. 12 is applicable to all of them as it is to all the apertures in section 71*a*. Thus all the apertures radiate in phase for maximum gain. If the apertures of sections 71*a* and 71*b* were respectively positioned below and above the centre line G—G the sense of the circular polarization would be reversed.

The obtaining of maximum gain requires an aperture in section 71*b* to be spaced λlg/2 further from the feed axis H-H than the corresponding aperture in section 71*a*. Thus if aperture 72*a*1 is at a distance a from axis H—H, aperture 72*b*1 is at a distance (a+λlg/2). If the longitudinal spacing of apertures 72*a*1 and 72b1 is to be λlg to maintain a constant array element spacing (which is not essential) then clearly a must equal λlg/4 which is the case shown in FIG. 10.

Turning to FIG. 11, the series fed version of the slotted-waveguide array of FIG. 10 is shown. As circular polarization is obtained from the two halves of the waveguide in essentially the same manner as with the array of FIG. 10 only those features of difference will be noted. In FIG. 11 the waveguide 71 is fed at a feed aperture 76 in the lower broad wall (i.e. the broad wall not having the radiating apertures). In each section 71*a* and 71*b*, the arrangement of the apertures 72 follows the principles given above, but with series feed the current patterns in the two halves are not mirror images about axis H—H. As drawn the current distribution in section 71*a* is shown the same as in FIG. 10; but that in section 71*b* is of opposite polarity. The obtaining of in-phase radiation from all the apertures 72 requires in this case corresponding apertures in the two waveguide halves 71*a* and 71*b* to be equidistant from axis H—H. Thus apertures 72*a*1 and 72*b*1 are both spaced at distance a. For the distance between these apertures λlg, a must be λlg/2. However, as above stated this is not essential and in the example shown in FIG. 11, a is again λlg/4.

One design of waveguide which is being investigated uses a core of polypropylene which has a dielectric constant ε of 2.1. The core is plated with copper to a thickness of 0.005 inches (approimately 13 μm.) using an electro-less technique. The slots are produced by making a mask and using photolithographic techniques to etch the copper. In describing the use of long linear arrays in the practice of the invention it has been generally assumed that the array is such as to uniformly fill the vertical aperture. This is not essential what is important is the provision of a beam-forming aerial the vertical aperture of which extends over a distance of not less than 0.75 m.

The Simmons article referred to above appears in IRE Transactions Vol. AP5, No. 1 (January, 1957) at pages 31–36.

I claim:

1. An intrusion sensor comprising a microwave transmitter and associated microwave aerial; and a microwave receiver and associated microwave aerial for receiving radiation transmitted by said microwave transmitter and its associated aerial, the transmitter, receiver and associated aerials being operable at a predetermined microwave frequency, the receiver including means responsive to a variation of the received radiation from an established level to give an intruder-indicative signal, wherein the transmitter and receiver aerials each have a vertical aperture dimensioned to provide at said predetermined frequency a beam pattern in a vertical plane, said vertical aperture being not less than 0.75 meters providing a beam pattern in a vertical plane, and said transmitter and receiver aerials are mounted adjacent the ground at opposite ends of a path to be monitored for the presence of intruders, the aerials being spaced along said path by a distance not exceeding that at which the striking angle to the ground of a notional ray traveling from the center of the receiving aerial by ground reflection equals half of the half-power beamwidth of either aerial, thereby providing in operation an intruder-sensitive zone of radiation which extends along said path contiguous to the ground substantially to each of said aerials.

2. An intrusion sensor as claimed in claim 1 wherein the vertical aperture of each of said transmitter and receiver aerials is 1.5 meters.

3. An intrusion sensor as claimed in claim 1 wherein each of said aerials has a half-power beamwidth in the vertical plane of not more than 2°.

4. An intrusion sensor as claimed in claim 3 wherein each of the transmitter and receiver aerials is circularly polarized.

5. An intrusion sensor as claimed in claim 1 wherein each of said transmitter and receiver aerials comprises a vertical array of radiator elements.

6. An intrusion sensor as claimed in claim 5 wherein each of said transmitter and receiver aerials comprises a slotted waveguide array.

7. An intrusion sensor as claimed in claim 6 wherein said frequency of operation is in one of the two portions of the frequency spectrum X-band and K-band.

8. An intrusion sensor as claimed in claim 6 wherein each slotted waveguide is filled with a dielectric material and adjacent slots in the array are spaced at a distance of one wavelength in the waveguide, the dielectric constant of said dielectric material being such that the absolute distance equal to one wavelength in the waveguide provides a spacing between adjacent slots in the range of one half to one wavelength in free space.

9. An intrusion sensor as claimed in claim 6 wherein in each slotted waveguide array each slot thereof is offset from the longitudinal axis of the waveguide wall in which the slot is formed to provide circular polarization.

10. In an intrusion sensor comprising a microwave transmitter and associated microwave aerial, and a microwave receiver and associated microwave aerial for receiving radiation transmitted by said microwave transmitter and its associated aerial, the transmitter, receiver and associated aerials being operable at a predetermined microwave frequency, and said aerials being located at opposite ends of a path to be monitored for the presence of intruders so as to establish an intruder-sensitive zone of radiation between the aerials; the improvement in which:

(a) each of said aerials has a vertical aperture of not less than 0.75 meters whereby said zone of radiation is at least 0.75 meters high along the length of said path;

(b) each of said aerials is mounted to have the lower end of its vertical aperture at or in the close proximity to ground level such that the height of said lower end of each vertical aperture from the ground is not more than a minor fraction of the length of the vertical aperture, whereby the microwave signal transmitted is essentially free of nulls irrespective of the length of said path, whereby said zone of radiation is continguous to the ground substantially to each of said aerials.

11. In an intrusion sensor comprising a microwave transmitter and associated microwave aerial, and a microwave receiver and associated microwave aerial for receiving radiation transmitted by said microwave transmitter and its associated aerial, the transmitter, receiver and associated aerials being operable at a predetermined microwave frequency, and said aerials being located at opposite ends of a path to be monitored for the presence of intruders so as to establish an intruder-sensitive zone of radiation between the aerials, and said path having along at least a part of its length surface discontinuities of variable height such as vegetation of seasonal growth liable to movement in the wind to as to vary the effective height of the ground with respect to the reflection of microwave energy; the improvement in which:

(a) each of said aerials has a vertical aperture of not less than 0.75 meters whereby said zone of radiation is at least 0.75 meters high along the length of said path;

(b) each of said aerials is mounted to have the lower end of its vertical aperture at or in the close proximity to ground level such that the height of said lower end of each vertical aperture from the ground is not more than a minor fraction of the length of the vertical aperture, whereby:

(i) the microwave signal transmitted is essentially free of nulls irrespective of the length of said path, or (ii) the strength of the transmitted radiation received along said path and beyond, as measured with the aid of an aerial dimensioned and mounted as specified for said receiver aerial, falls smoothly with distance and is essentially free of nulls at any distance, and the signal received at said microwave receiver is substantially insensitive to variations in the effective height of the ground along said path, whereby said zone of radiation is contiguous to the ground substantially to each of said aerials.

* * * * *